US007207844B2

(12) United States Patent
Peng

(10) Patent No.: US 7,207,844 B2
(45) Date of Patent: Apr. 24, 2007

(54) CONNECTOR ASSEMBLY WITH ANGULAR POSITIONING STRUCTURE

(75) Inventor: Robert Peng, Jhonghe (TW)

(73) Assignee: F-Time Technology Industrial Co., Ltd. (TW)

( * ) Notice: Subject to any disclaimer, the term of this patent is extended or adjusted under 35 U.S.C. 154(b) by 0 days.

(21) Appl. No.: 11/431,586

(22) Filed: May 11, 2006

(65) Prior Publication Data

US 2006/0264080 A1 Nov. 23, 2006

(30) Foreign Application Priority Data

May 18, 2005 (TW) ..... 94208006 U

(51) Int. Cl.
*H01R 25/00* (2006.01)

(52) U.S. Cl. ..... 439/640; 439/582; 439/954; 439/173

(58) Field of Classification Search ..... 439/446, 439/171, 173, 640, 680, 954, 777, 582
See application file for complete search history.

(56) References Cited

U.S. PATENT DOCUMENTS

| | | | | |
|---|---|---|---|---|
| 903,768 | A * | 11/1908 | Platt | 439/551 |
| 6,419,519 | B1 * | 7/2002 | Young | 439/446 |
| 6,641,436 | B2 * | 11/2003 | Baffert | 439/582 |
| 6,793,528 | B2 * | 9/2004 | Lin et al. | 439/582 |

* cited by examiner

*Primary Examiner*—Tho D. Ta
(74) *Attorney, Agent, or Firm*—Bacon & Thomas PLLC

(57) ABSTRACT

A connector assembly comprising a pair of male connecting piece and female connecting piece which are connected to each other, and angular positioning means between the male connecting piece and the female connecting piece achieved by matching and inserting an angular position tenon block formed on the male connecting piece with and into the respective angular positioning mortise hole formed on the main-body of the female connecting piece, when the male connecting piece and female connecting piece are connected to each other to form electric connection, the angular position of the male connecting piece relative to the female connecting piece shall be varied simply by matching and inserting the angular positioning tenon block on the male connecting piece with and into the selected angular positioning mortise hole on the female connecting piece.

8 Claims, 3 Drawing Sheets

CONNECTOR ASSEMBLY WITH ANGULAR POSITIONING STRUCTURE

BACKGROUND OF THE INVENTION

1. Field of the Present Invention

The invention relates to a connector assembly, particularly the connector assembly with angular positioning structure.

2. Description of Prior Art

Normally the conventional type connector assembly comprises a pair of male connecting piece and female connecting piece which are connected to each other to form electric connection that enables the connector assembly as an apparatus for transmitting electronic signal between electronic devices.

However under some specific purpose of application when the male and female piece of the connector assembly are connected to each other to form electric connection it requires that the male piece must be arranged in some selected angular position relative to the female piece. However, since the conventional type connector assembly has no angular positioning structure, it is really difficult for the conventional type connector to achieve the aforesaid purpose of arranging the male piece in some specific angular position relative to the female piece when they are connected to each other that results in the inconveniency in use and the need of further improvement of the conventional type connector assembly.

SUMMARY OF THE INVENTION

In view of the above-mentioned shortcoming the major purpose of the invention is to disclose a connector assembly comprising a pair of male and female connecting piece which are connected to each other, and has angular positioning structure formed between the male and female connecting piece of the connector assembly. When the male piece and female piece are connected to each other the male piece can be arranged in some selected angular position relative to the female piece by means of the angular positioning structure.

The minor purpose of the invention is to disclose a connector assembly comprising a pair of male and female connecting piece which are connected to each other, the positioning tenon block formed on the male connecting piece, and several angular positioning mortise holes formed on the female connecting piece arranged. When the male connecting piece and the female connecting piece are connected to each other to form electric connection the angular position of the male piece relative to the female piece can be varied simply by matching and inserting the positioning tenon block on the male piece with and to different angular positioning mortise hole on the female connecting piece.

Another purpose of the invention is to disclose another kind of connector assembly comprising a pair of male and female connecting piece, wherein the positioning tenon block is formed on the female connecting piece, and several positioning mortise holes are formed on the male connecting piece. When the male connecting piece and female connecting piece are connected to each other to form electric connection, the angular position of the female connecting piece relative to the male connecting piece can be varied simply by matching and inserting the positioning tenon block on the female connecting piece with and to different angular positioning mortise holes on the male connecting piece.

DETAILED DESCRIPTION OF THE PREFERRED EMBODIMENTS

Figure 1:
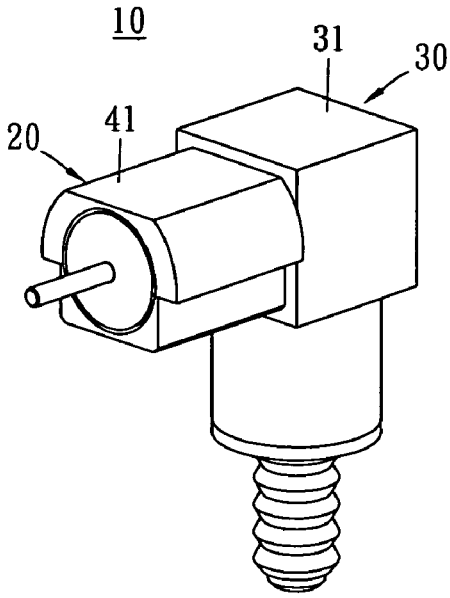
FIG. 1 is the schematic drawing of the connector assembly of the invention.
Figure 2:
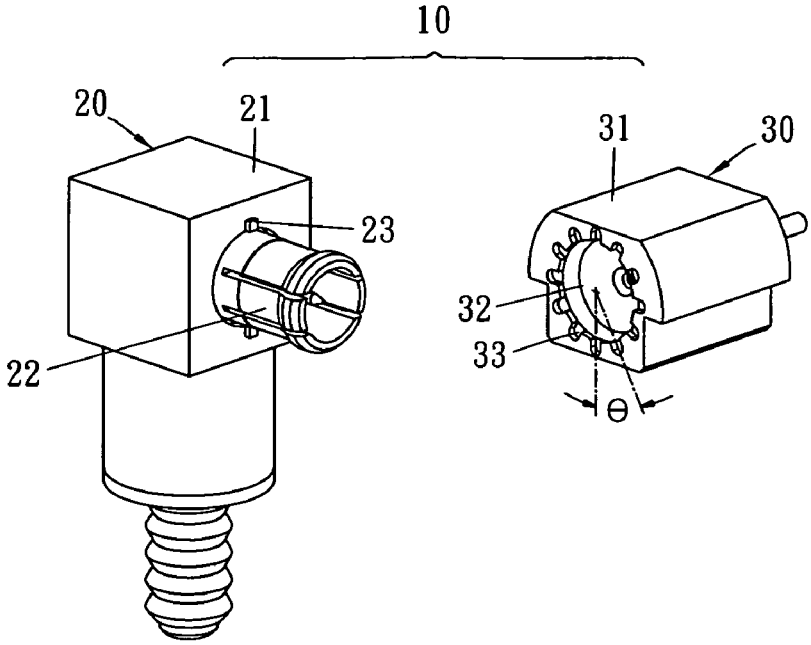
FIG. 2 is the disassembly drawing of the connector assembly shown in FIG. 1 comprising a male connecting piece and a female connecting piece.
Figure 3A:
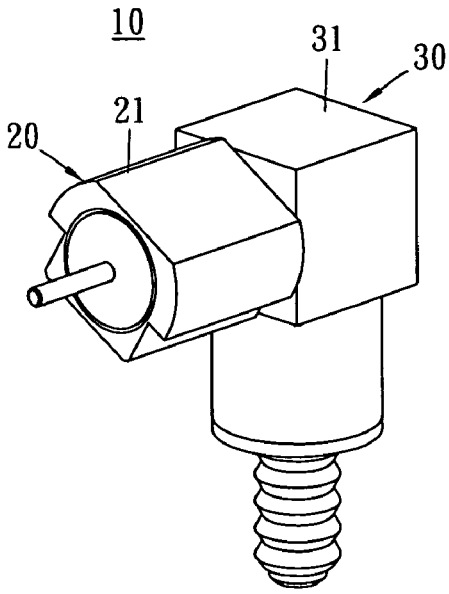
FIGS. 3*a*~3*d* is the schematic drawing of the connector assembly shown in FIG. 1 showing the variation of the angular position of the male connecting piece relative to the female connecting piece by means of the angular positioning structure arranged between the male connecting piece and the female connecting piece.
Figure 3B:
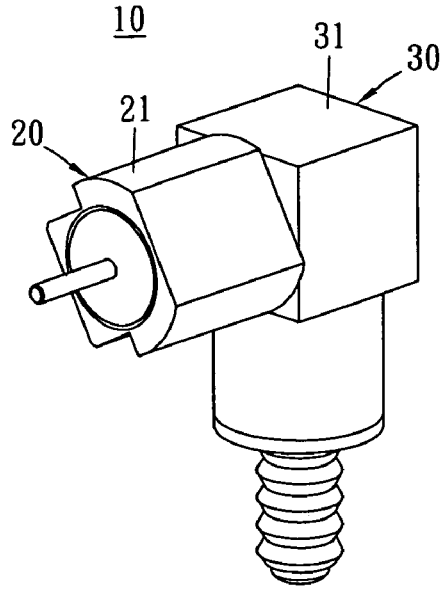
Figure 3D:
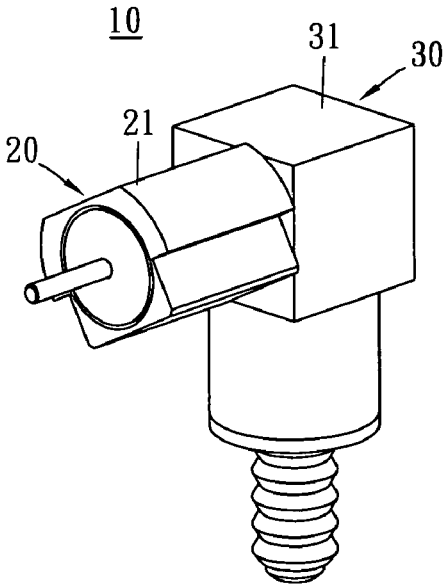
Figure 3C:
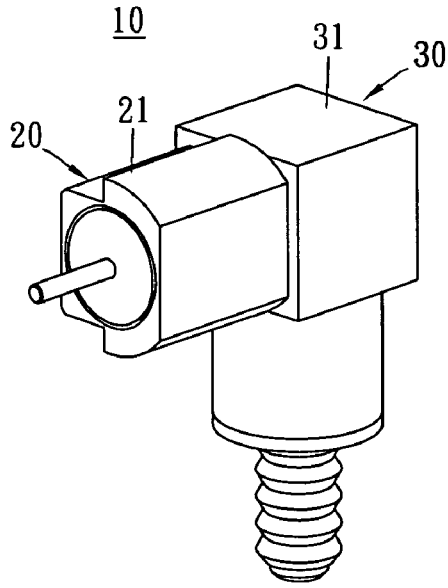

Referring to FIG. 1 and FIG. 2, the connector assembly 10 disclosed in the invention comprises a pair of male connecting piece 20 and female connecting piece 30, wherein the male connecting piece 20 has a plug portion 22 formed on the main-body 21, and the female connecting piece 30 has a socket portion 32 formed on the main-body 31. When the plug portion 22 of the male connecting piece 20 is inserted into the socket portion 32 of the female connecting piece 30, an electric connection is formed by the male and female connecting piece.

The positioning tenon block 23 is formed on the main-body 21 of the male connecting piece 20, and is arranged on the circumference of the common border surface between the main-body 21 and the plug portion 22 of the male connecting piece 20.

The angular positioning mortise holes 33 are arranged on the socket portion 32 and are arranged at an angular interval of "θ" along the circumference of the opening of the socket portion 32 of the main-body 31 of the female connecting piece 30.

Therefore, when the male connecting piece 20 and the female connecting piece 30 are connected to each other, the positioning tenon block 23 on the male connecting piece 20 can be matched with and inserted into any selected angular positioning mortise hole 33, and a specific angle "θ" is set for the angular interval between any two adjacent mortise holes.

As shown in FIG. 3, when the plug portion 22 of the male connecting piece 20 and the socket portion 32 of the female connecting piece are connected to each other to form electric connection the positioning tenon block 23 of the male connecting piece 20 will be inserted into and fixed by the selected angular positioning mortise hole 33 which can prevent the rotation movement between the male and female connecting piece.

Moreover, when the plug portion 22 of the male connecting piece 20 and the socket portion 32 of the female connecting piece are connected to each other to form electric connection, the variation of the angular position of the male connecting piece 20 relative to the female connecting piece 30 including such as θ, 2θ, 3θ or 4θ etc. can be achieved by inserting the positioning tenon block 23 into respective angular positioning mortise hole arranged for specific angle of connection.

As shown in FIGS. 2 and 3, when the angle between two adjacent angular positioning mortise holes is set at 30°, a total number of twelve angular positions of the positioning mortise hole 33 can be arranged along the circumference of the opening of the socket portion 32 of the female connecting piece 30. Therefore, by inserting the positioning tenon block 23 of the male connecting piece into the respective angular positioning mortise hole 33 of the female connecting piece 30 the angular position of the male connecting piece relative to the female connecting piece 30 can be varied through twelve different positions of 30 degrees, 60 degrees, 90 degrees, 120 degrees, 150 degrees and 180 degrees etc.

Similarly, when the angle between two adjacent positioning mortise holes 33 is set at 15°, a total number of twenty-four angular positions of the angular positioning mortise hole 33 can be arranged along the circumference of the opening of the socket portion 32 of the female connecting piece 30, and therefore the total number of variation of angular position of the male connecting piece relative to the female connecting piece has twenty-four different positions.

As for the present example of embodiment of the invention the angle between two positioning mortise holes 33 of the female connecting piece 30 is set at 10 degrees, 15 degrees and 30 degrees.

Figure 4:
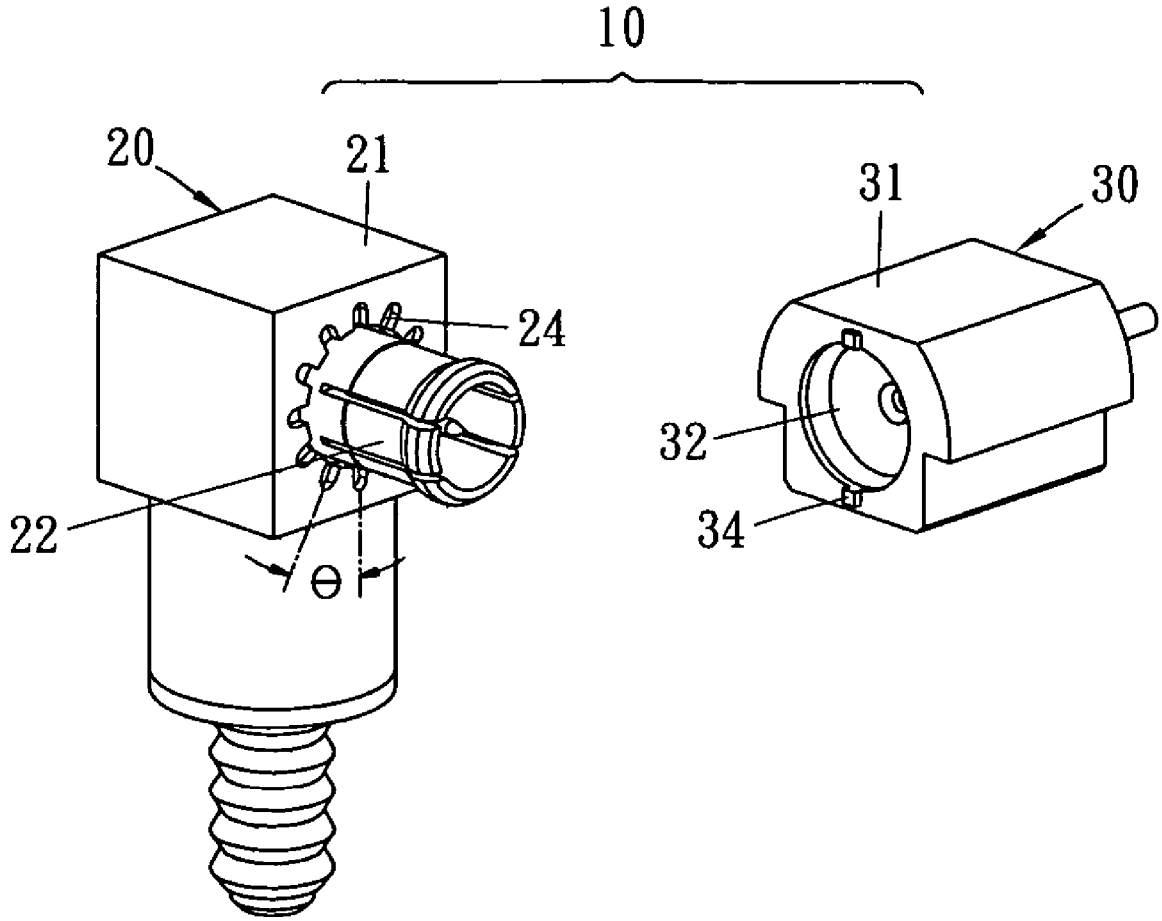
FIG. 4 is the structural drawing of the second example of embodiment of the connector assembly disclosed in the invention.

Referring to FIG. 4, another example of embodiment of the connector assembly 10 of the present invention has positioning tenon block 34 formed along the circumference of the opening of the socket portion 32 of the female connecting piece 30, and several positioning mortise holes 24 formed along the common border surface arranged at an angular interval of "θ" between each mortis hole, and the angular interval "θ" for the example of embodiment is set at 10 degrees or 15 degrees or 30 degrees.

Therefore, the main-body 21 of the male connecting piece 20 has several angular positioning mortise holes 24, and any one of the angular positioning mortise holes 24 can be selected to match and for being inserted by the positioning tenon block 34 of the female connecting piece to form electric connection. And, by varying the positioning mortise holes 24 for matching and being inserted by the positioning tenon block 34 the variation of the angular position of the male connecting piece relative to the female connecting piece can be easily achieved.

What is claimed is:

1. A connector assembly with angular positioning structure comprising a male connecting piece and female connecting piece which are connected to each other, wherein the male connecting piece has a plug portion and the female connecting piece has a socket portion, and the plug portion of the male connecting piece is configured for insertion into the socket portion of the female connecting piece to form an electric connection, wherein a positioning tenon block is formed on the male connecting piece, and plural angular positioning mortise holes are formed and arranged at an angular interval θ along the circumference of the opening of the socket portion of the female connecting piece for receiving the positioning tenon block of the male connecting piece at a selected angular position.

2. The connector assembly according to claim 1, wherein the angular interval between two adjacent angular positioning mortise holes on the female connecting piece is 10 degrees.

3. The connector assembly according to claim 1, wherein the angular interval between two adjacent angular positioning mortise holes on the female connecting piece is 15 degrees.

4. The connector assembly according to claim 1, wherein the angular interval between two adjacent angular positioning mortise holes on the female connecting piece is 30 degrees.

5. A connector assembly with angular positioning structure comprising a male connecting piece and female connecting piece which are connected to each other, wherein the male connecting piece has a plug portion and the female connecting piece has a socket portion, and the plug portion of the male connecting piece is configured for insertion into the socket portion of the female connecting piece to form an electric connection, wherein a positioning tenon block is formed on the circumference of the opening of the socket portion of the female connecting piece, and plural angular positioning mortise holes are formed and arranged at an angular interval θ along the circumference of the plug portion of the male connecting piece for receiving the positioning tenon block on the female connecting piece at a selected angular position.

6. The connector assembly according to claim 5, wherein angular interval between two adjacent angular positioning mortise holes on the male connecting piece is 10 degrees.

7. The connector assembly according to claim 5, wherein the angular interval between two adjacent angular positioning mortise holes on the male connecting piece is 15 degrees.

8. The connector assembly according to claim 5, wherein the angular interval between two adjacent angular positioning mortise holes on the male connecting piece is 30 degree.

* * * * *